US011530865B2

(12) United States Patent
Hong et al.

(10) Patent No.: US 11,530,865 B2
(45) Date of Patent: Dec. 20, 2022

(54) REFRIGERATOR

(71) Applicant: SAMSUNG ELECTRONICS CO., LTD., Suwon-si (KR)

(72) Inventors: Daejin Hong, Suwon-si (KR); Hosang Park, Suwon-si (KR); Byungwoo Jeon, Suwon-si (KR); In-yong Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 176 days.

(21) Appl. No.: 16/849,373

(22) Filed: Apr. 15, 2020

(65) Prior Publication Data

US 2020/0326116 A1 Oct. 15, 2020

(30) Foreign Application Priority Data

Apr. 15, 2019 (KR) ..... 10-2019-0043720

(51) Int. Cl.
*F25D 17/06* (2006.01)

(52) U.S. Cl.
CPC .... *F25D 17/065* (2013.01); *F25D 2317/0671* (2013.01); *F25D 2317/0672* (2013.01)

(58) Field of Classification Search
CPC ..... F25D 17/056; F25D 2317/0671; F25D 2317/0672; F25D 23/061; F25D 26/063; F25D 19/00; F25D 2317/067; F25D 17/065; F25D 23/063; F25D 23/006; F25D 11/022
See application file for complete search history.

(56) References Cited

U.S. PATENT DOCUMENTS

| | | | | |
|---|---|---|---|---|
| 4,917,256 A * | 4/1990 | Kruck | B29C 44/146 206/545 |
| 7,895,858 B2 * | 3/2011 | Hell | F25D 19/00 62/298 |
| 9,581,377 B2 | 2/2017 | Kim et al. | |
| 2013/0000333 A1 * | 1/2013 | Kim | F25D 17/065 62/407 |

FOREIGN PATENT DOCUMENTS

| | | | |
|---|---|---|---|
| CN | 101113861 | 1/2008 | |
| CN | 103097839 | 5/2013 | |
| CN | 110411070 A * | 11/2019 | F25B 39/02 |
| JP | 2001074348 A * | 3/2001 | F25B 25/00 |
| KR | 1998-019822 | 7/1998 | |
| KR | 10-0724445 | 6/2007 | |
| KR | 10-2007-0075835 | 7/2007 | |

(Continued)

OTHER PUBLICATIONS

Extended European Search Report dated Aug. 28, 2020 from Application No. 20168830.6, 7 pages.

(Continued)

*Primary Examiner* — Emmanuel E Duke
(74) *Attorney, Agent, or Firm* — Staas & Halsey LLP

(57) ABSTRACT

A refrigerator includes a plurality of wall modules and a cooling module. At least one of a rear wall module, a left wall module, or a right wall module includes a supply duct provided to supply cold air produced by the cooling module to a storeroom, and a collecting duct to bring air having exchanged heat from the storeroom back to the cooling module.

13 Claims, 11 Drawing Sheets

(56) References Cited

FOREIGN PATENT DOCUMENTS

| | | | | | |
|---|---|---|---|---|---|
| KR | 10-2009-0101525 | | | 9/2009 | |
| KR | 10-0998911 | | | 12/2010 | |
| KR | 10-2015-0053064 | | | 5/2015 | |
| KR | 20180091362 | A | * | 8/2018 | ..... F25D 11/02 |
| WO | 2006/045700 | | | 5/2006 | |

OTHER PUBLICATIONS

International Search Report dated Aug. 3, 2020 from International Application No. PCT/KR2020/004972, 3 pages.
European Office Action dated Aug. 26, 2022 for European Application No. 20168830.6.
Chinese Office Action dated Aug. 31, 2022 for Chinese Application No. 202080028569.2.

* cited by examiner

REFRIGERATOR

CROSS-REFERENCE TO RELATED APPLICATION

This application is based on and claims priority under 35 U. S. C. § 119 to Korean Patent Application No. 10-2019-0043720 filed on Apr. 15, 2019, in the Korean Intellectual Property Office, the disclosure of which is incorporated by reference herein in its entirety.

BACKGROUND

1. Field

The disclosure relates to a refrigerator, and more particularly, to a refrigerator having a main body formed by assembling a plurality of wall modules and a cooling module.

2. Description of Related Art

Refrigerators are home appliances equipped with a main body having a storeroom, a cold air supplier for supplying cold air to the storeroom and a door for opening or closing the storeroom to keep food fresh.

In general, the main body of the refrigerator is manufactured by molding inner and outer cases, assembling the outer case onto the outside of the inner case, and injecting and foaming insulation between the inner and outer cases.

However, the method requires more workforce, expenses and time in manufacturing and managing the main body due to the bulky inner and outer cases, and when a fault occurs in a local part of the refrigerator after foaming of the insulation, the local part cannot be repaired and replaced and thus the entire refrigerator needs to be discarded.

SUMMARY

The disclosure provides a refrigerator having a main body formed by assembling a plurality of wall modules and a cooling module.

The disclosure also provides a refrigerator having a plurality of wall modules equipped with a duct through which to transfer cold air.

According to an embodiment of the disclosure, a refrigerator includes a plurality of wall modules including a top wall module, a bottom wall module, a rear wall module, a left wall module, and a right wall module to define a storeroom; and a cooling module including a compressor, a condenser, and an evaporator to produce cold air, wherein at least one of the rear wall module, the left wall module, or the right wall module includes a supply duct provided to supply the cold air produced from the cooling module into the storeroom; and a collecting duct provided to bring air having exchanged heat in the storeroom back to the cooling module.

The wall module including the supply duct and the collecting duct may include an inner case defining the storeroom, an outer case coupled to an outer surface of the inner case, and insulation provided between the inner case and the outer case, and the supply duct and the collecting duct may be buried in the insulation.

The inner case may include a supply hole formed to supply cold air supplied through the supply duct into the storeroom.

The supply duct may be linked to the supply hole.

The inner case may include a collecting hole formed to guide air in the storeroom into the collecting duct.

The collecting duct may be linked to the collecting hole.

The cooling module may be coupled onto a lower portion of the rear wall module to define at least a portion of the rear surface of the storeroom.

The cooling module may include a cold air producing space in which the evaporator is mounted and cold air is produced, and insulation provided to insulate the cold air producing space.

The cooling module may include an outflow duct guiding the cold air produced in the cold air producing space to the outside of the cooling module; and an inflow duct guiding air outside the cooling module into the cold air producing space.

The outflow duct and the inflow duct may be buried in the insulation.

When the wall module including the supply duct and the collecting duct and the cooling module are coupled to each other, the outflow duct and the supply duct may be linked to each other and the inflow duct and the collecting duct may be linked to each other, and when the wall module including the supply duct and the collecting duct and the cooling module are decoupled from each other, the outflow duct and the supply duct may be decoupled from each other and the inflow duct and the collecting duct may be decoupled from each other.

The cooling module may include a cooling module body defining the cold air producing space, and a cooling module cover coupled to the cold air module body to cover the cold air producing space.

The refrigerator may further include a blower fan mounted on the cooling module cover to circulate air between the storeroom and the cold air producing space.

The rear wall module and the cooling module may be integrated in one unit.

According to another embodiment of the disclosure, a refrigerator includes a plurality of wall modules including a top wall module, a bottom wall module, a rear wall module, a left wall module, and a right wall module; and a storeroom formed by the plurality of wall modules, wherein the rear wall module may include a cold air producing space in which an evaporator is mounted for producing cold air; a supply duct provided to supply the cold air produced in the cold air producing space into the storeroom; and a collecting duct provided to bring air having exchanged heat in the storeroom back to the cold air producing space.

The rear wall module may include an inner case defining the storeroom, an outer case coupled to an outer surface of the inner case, and insulation provided between the inner case and the outer case, and wherein the supply duct and the collecting duct are buried in the insulation.

The inner case may include a supply hole formed to supply cold air supplied through the supply duct into the storeroom.

The supply duct may be linked to the supply hole.

The inner case may include a collecting hole formed to guide air in the storeroom into the collecting duct.

The collecting duct may be linked to the collecting hole.

BRIEF DESCRIPTION OF THE DRAWINGS

The above and other objects, features and advantages of the disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
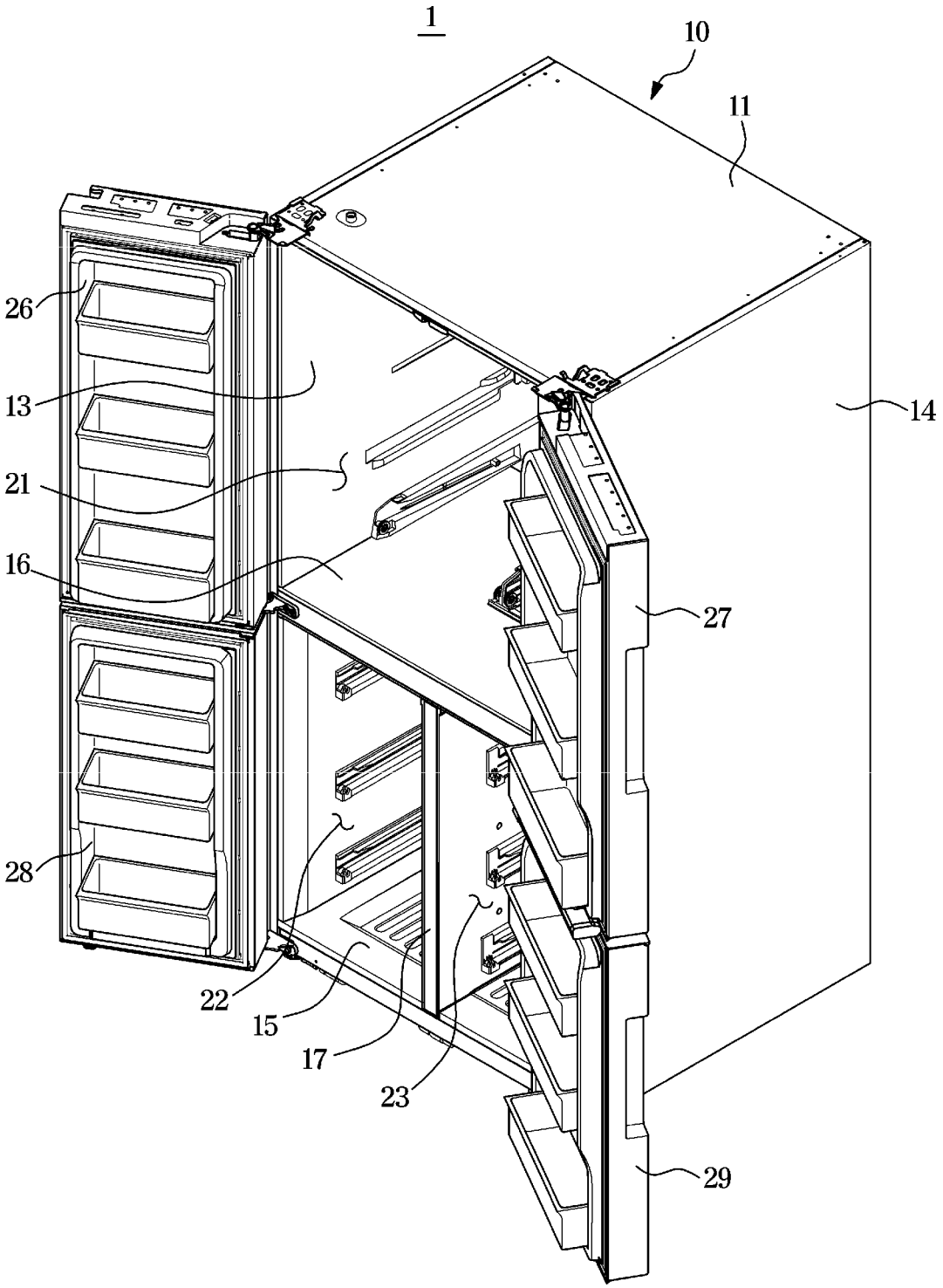
FIG. 1 is a perspective view of a refrigerator, according to an embodiment of the disclosure.

Embodiments of the disclosure are only the most preferred examples and provided to assist in a comprehensive understanding of the disclosure as defined by the claims and their equivalents. Accordingly, those of ordinary skilled in the art will recognize that various changes and modifications of the embodiments described herein can be made without departing from the scope and spirit of the disclosure.

As used herein, the singular forms "a", "an" and "the" are intended to include the plural forms as well, unless the context clearly indicates otherwise. For the sake of clarity, the elements of the drawings are drawn with exaggerated forms and sizes.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Reference will now be made in detail to embodiments of the disclosure, examples of which are illustrated in the accompanying drawings, wherein like reference numerals refer to the like elements throughout.

Figure 2:
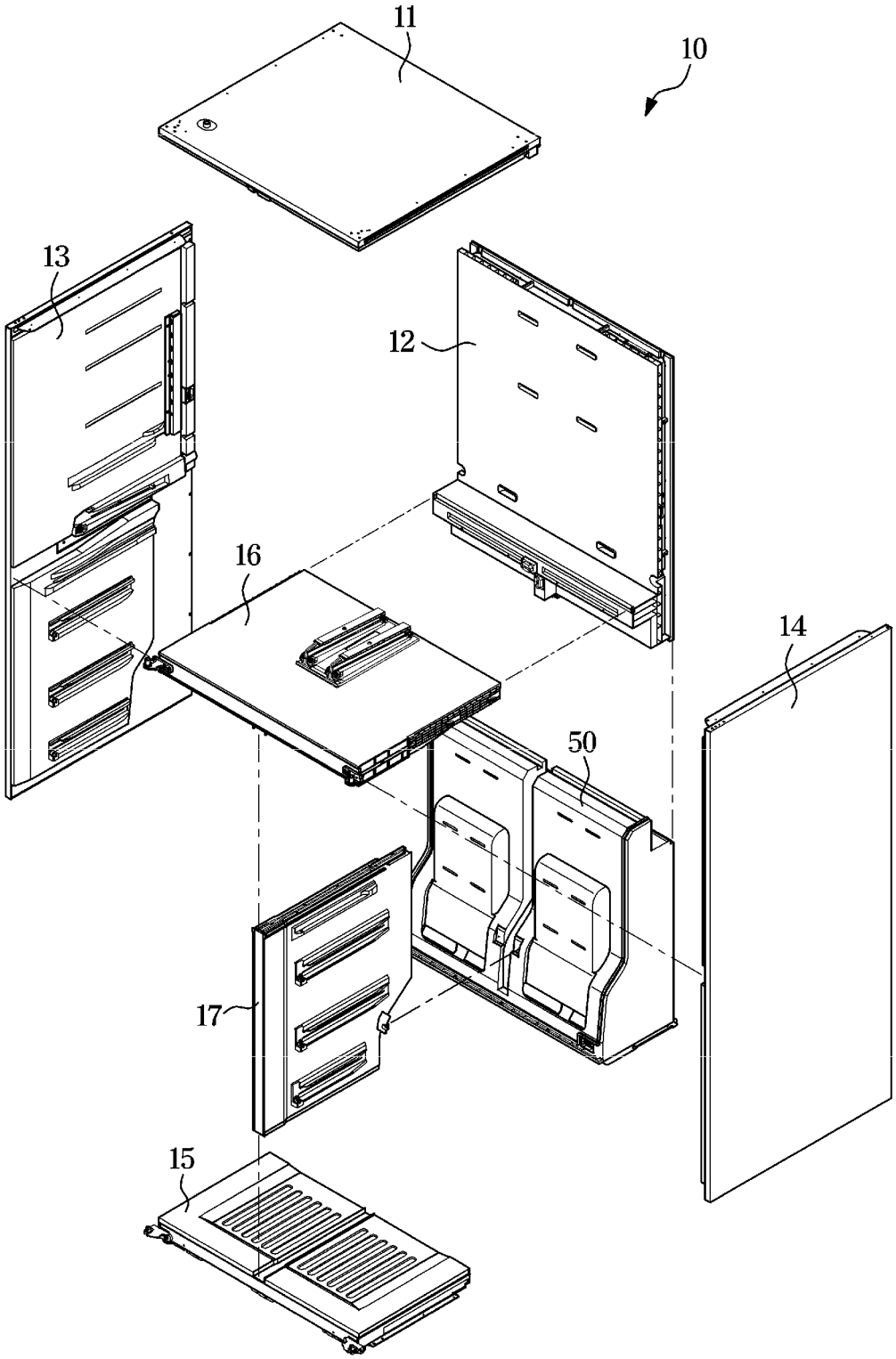
FIG. 2 shows a refrigerator broken down into a plurality of wall modules and a cooling module, according to an embodiment of the disclosure.

FIG. 1 is a perspective view of a refrigerator, according to an embodiment of the disclosure. FIG. 2 shows a refrigerator broken down into a plurality of wall modules and a cooling module, according to an embodiment of the disclosure.

Referring to FIGS. 1 and 2, a refrigerator 1 may include a main body 10, storerooms 21, 22, and 23 formed in the main body 10 to store food, and doors 26, 27, 28, and 29 provided to open or close the storerooms 21, 22, and 23.

The main body 10 may be formed by combining a plurality of wall modules 11 to 17 and a cooling module 50. The plurality of wall modules 11 to 17 may define the storerooms 21, 22, and 23. The plurality of wall modules 11 to 17 may include insulation to insulate the storerooms 21, 22, and 23.

The plurality of wall modules 11 to 17 may include a top wall module 11, a rear wall module 12, a left wall module 13, a right wall module 14, a bottom wall module 15, a horizontal middle wall module 16, and a vertical middle wall module 17. The storerooms 21 may be divided by the horizontal middle wall module 16 into an upper storeroom 21 and lower storerooms 22 and 23. The lower storerooms 22 and 23 may be divided by the vertical middle wall module 17 into the storerooms 22 and 23.

The plurality of wall modules 11 to 17 may have the form of substantially rectangular panels. The plurality of wall modules 11 to 17 may each be formed with an inner case defining the storeroom, an external case coupled to the outer surface of the inner case, and insulation provided between the inner case and the outer case. The insulation may include foam insulation. Specifically, the insulation may be molded by injecting a foaming liquid in which urethane and a blowing agent are mixed up into internal space formed by the inner case and the outer case and foaming the injected foaming liquid.

The cooling module 50 may be coupled to a lower portion of the rear wall module 12. The cooling module 50 may define at least a portion of the storerooms 22 and 23.

The cooling module 50 may include a compressor, a condenser, an evaporator, and an expansion device for producing cold air through a refrigeration cycle. The cold air produced by the cooling module 50 may be supplied directly into the storerooms 22 and 23 or into the storeroom 21 via the rear wall module 12 or the side wall modules 13 and 14.

For this, a duct for transfer of the cold air may be provided in the rear wall module 12 or the side wall modules 13 and 14. A structure of the duct will be described later in detail.

The plurality of wall modules 11 to 17 and the cooling module 50 may be interlocked and then coupled to each other through a fastening member such as screws, bolts, rivets, pins, etc. The plurality of wall modules 11 to 17 and the cooling module 50 may be decoupled from one another by releasing the fastening members and pulling the interlocked portion.

Figure 3:
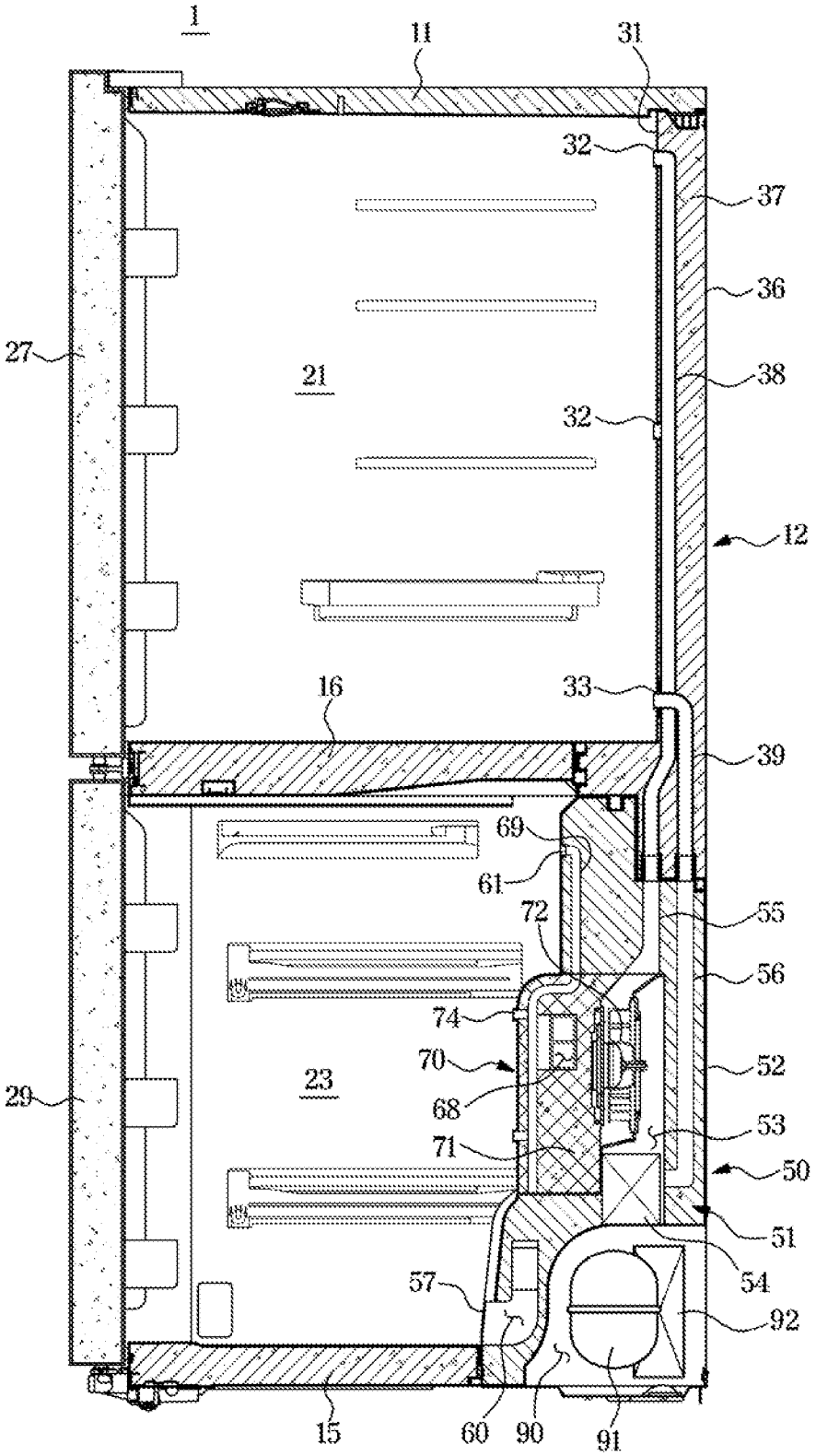
FIG. 3 is a schematic side cross-sectional view illustrating a main configuration of a refrigerator, according to an embodiment of the disclosure.
Figure 4:
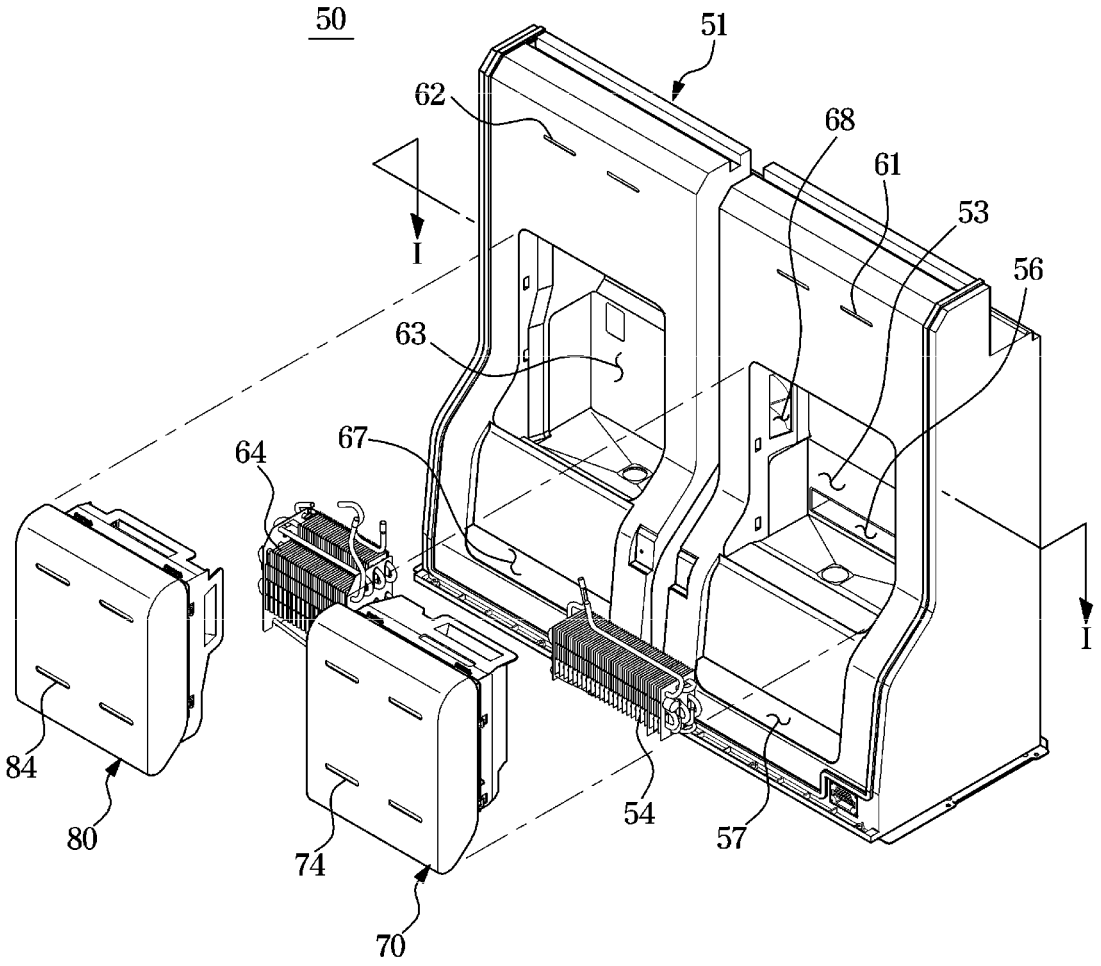
FIG. 4 is an exploded view of a cooling module of a refrigerator, according to an embodiment of the disclosure.
Figure 5:
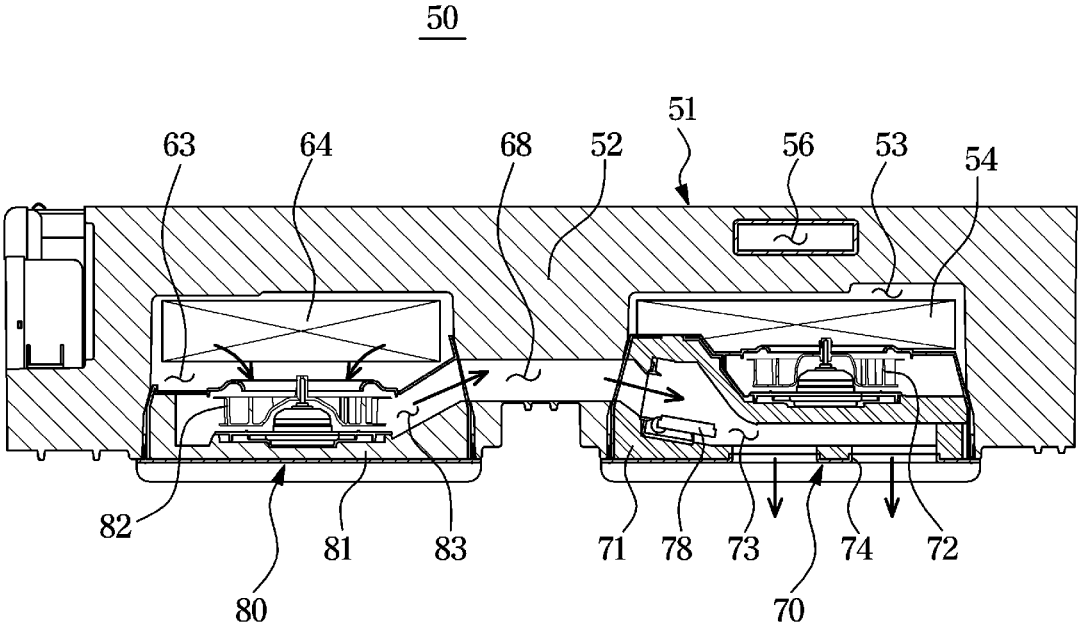
FIG. 5 is a cross-sectional view of a cooling module of a refrigerator cut along line I-I of FIG. 4, according to an embodiment of the disclosure.
Figure 6:
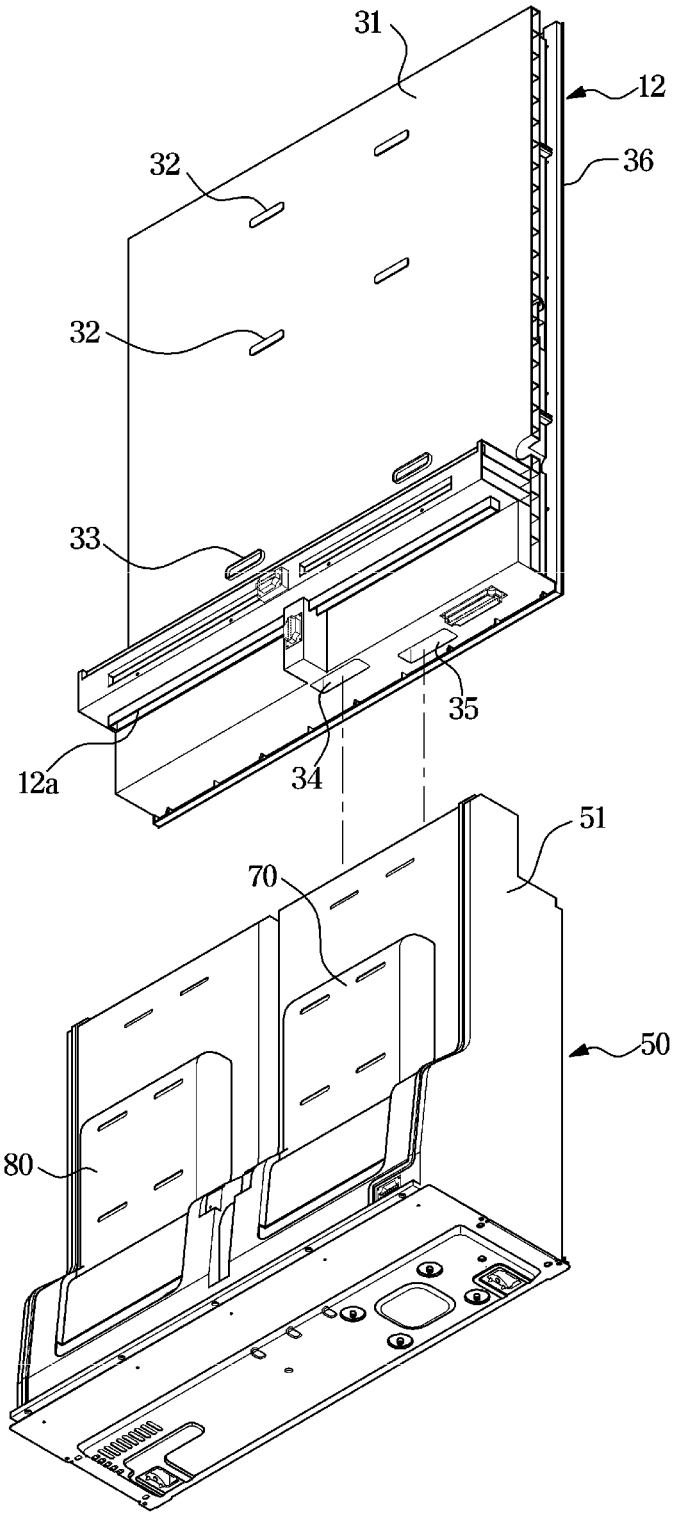
FIG. 6 is a perspective view of a structure of a rear wall module and a cooling module to be combined, according to an embodiment of the disclosure.
Figure 7:
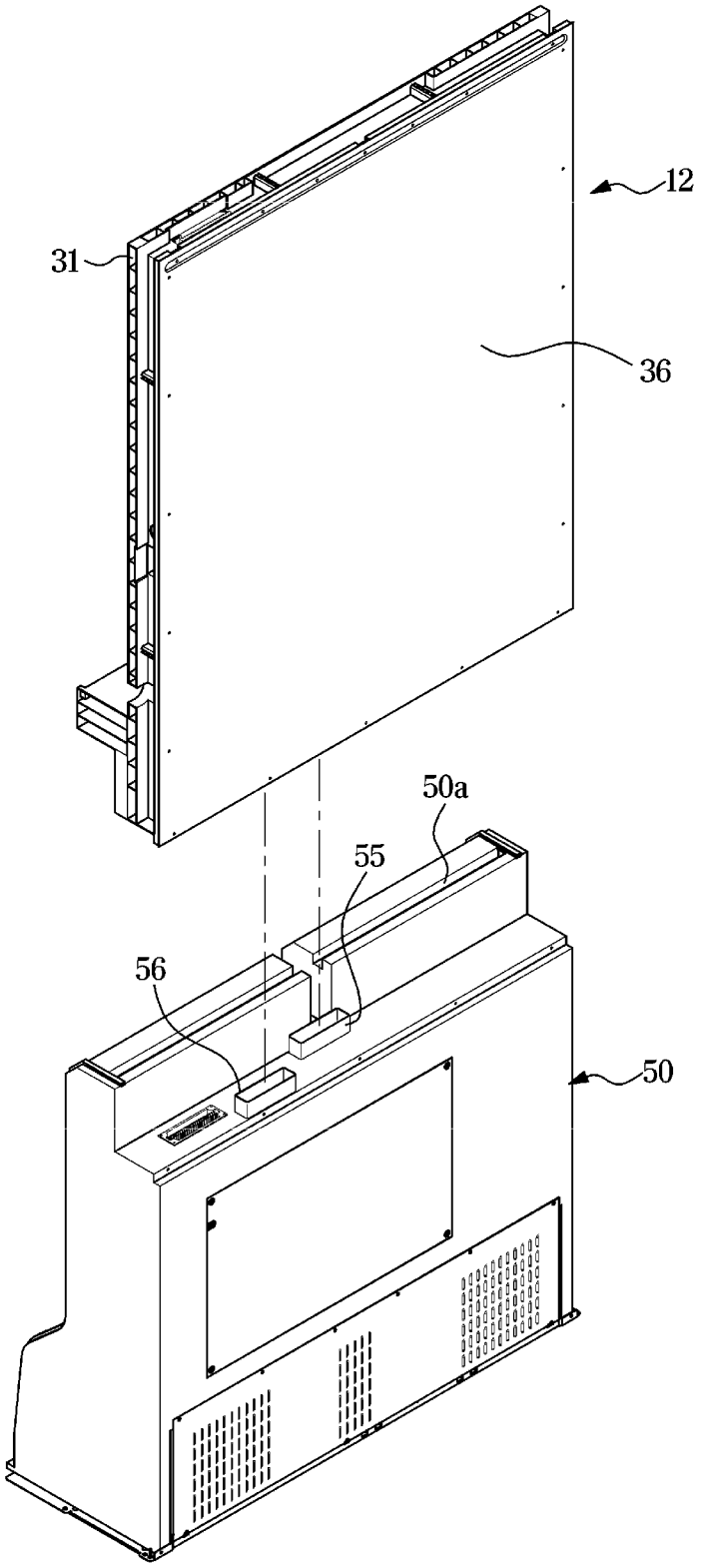
FIG. 7 is a rear perspective view of a structure of a rear wall module and a cooling module to be combined, according to an embodiment of the disclosure.
Figure 8:
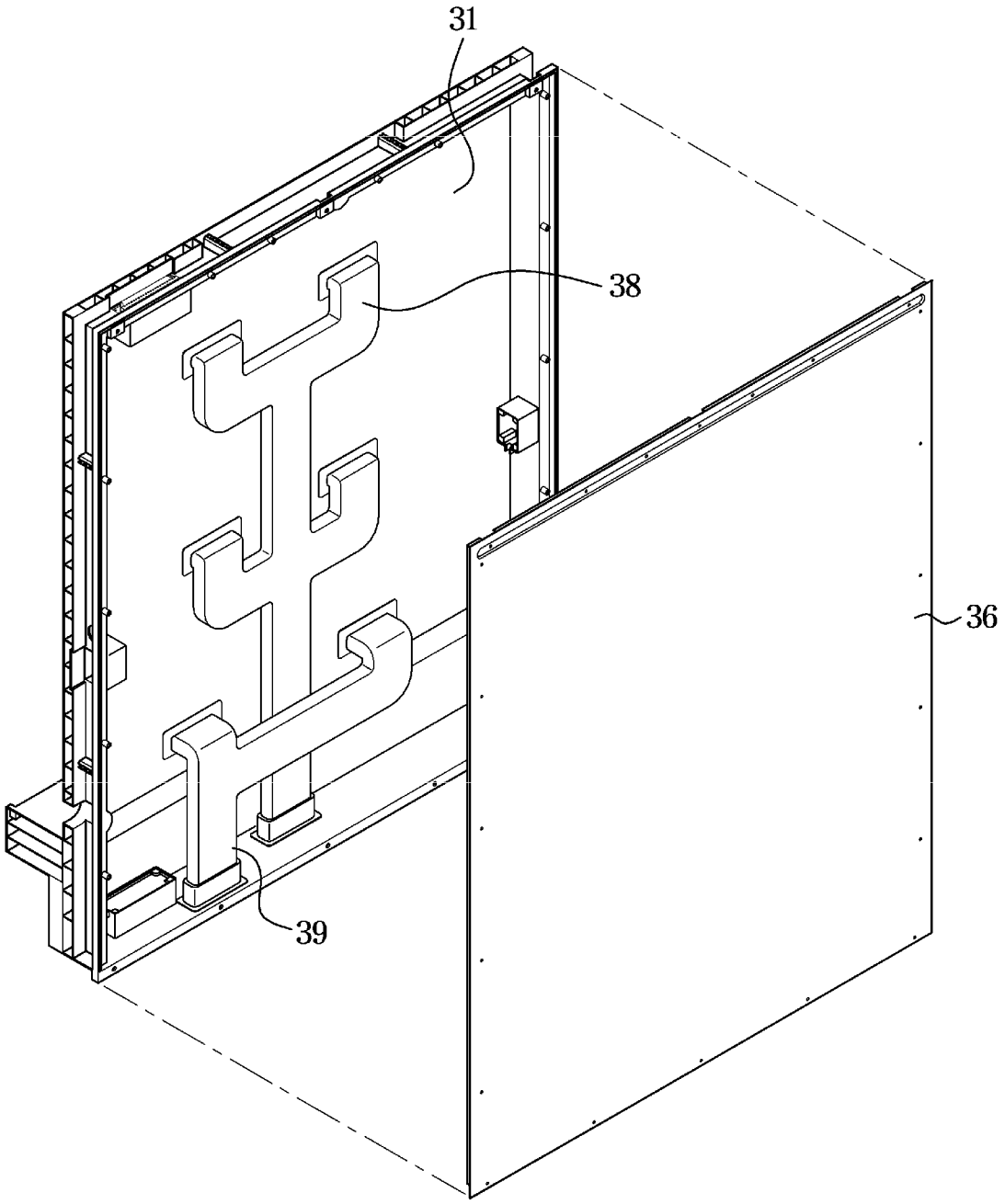
FIG. 8 shows a rear wall module broken down into an inner case and an outer case, according to an embodiment of the disclosure.

FIG. 3 is a schematic side cross-sectional view illustrating a main configuration of a refrigerator, according to an embodiment of the disclosure. FIG. 4 is an exploded view of a cooling module of a refrigerator, according to an embodiment of the disclosure. FIG. 5 is a cross-sectional view of a cooling module of a refrigerator cut along line I-I of FIG. 4, according to an embodiment of the disclosure. FIG. 6 is a perspective view of a structure of a rear wall module and a cooling module to be combined, according to an embodiment of the disclosure. FIG. 7 is a rear perspective view of a structure of a rear wall module and a cooling module to be combined, according to an embodiment of the disclosure. FIG. 8 shows a rear wall module broken into an inner case and an outer case, according to an embodiment of the disclosure.

Referring to FIGS. 3 to 8, a structure of a rear wall module and a cooling module of a refrigerator to be combined, and a structure of a duct in the rear wall module will now be described.

The cooling module 50 may include a compressor 91, a condenser 92, evaporators 54 and 64, and an expansion device (not shown) for producing cold air through a refrigeration cycle. The cooling module 50 may include a machine room 90 formed on the lower side, and the compressor 91 and the condenser 92 may be arranged in the machine room 90. The evaporators 54 and 64 may be arranged in cold air producing spaces 53 and 63 of the cooling module 50.

The cooling module 50 may include a cooling module body 51 defining the cold air producing spaces 53 and 63, and cooling module covers 70 and 80 coupled to the cooling module body 51 to cover the cold air producing spaces 53 and 63. The cold air producing spaces 53 and 63 may be formed to have an open front, and the cooling module covers 70 and 80 may be coupled to the cooling module body 51 to cover the open front of the cold air producing spaces 53 and 63.

The evaporators 54 and 64 may include a first evaporator 54 for cooling the first storeroom 21 on the upper side, and a second evaporator 64 for cooling the second and third storerooms 22 and 23 on the lower side.

The cold air producing spaces 53 and 63 may include a first cold air producing space 53 in which the first evaporator 54 is arranged, and a second cold air producing space 63 in which the second evaporator 64 is arranged.

The cooling module covers 70 and 80 may include a first cooling module cover 70 for covering the first cold air producing space 53, and a second cooling module cover 80 for covering the second cold air producing space 63.

The cooling module body 51 and the cooling module covers 70 and 80 may each include insulation 71 and 81 to insulate the cold air producing spaces 53 and 63. The cold air produced in the cold air producing spaces 53 and 63 may be enclosed by the insulation 71 and 81 and may not leak out.

A first blower fan 72 for circulating the cold air produced in the first cold air producing space 53 may be mounted on the first cooling module cover 70. A second blower fan 82 for circulating the cold air produced in the second cold air producing space 63 may be mounted on the second cooling module cover 80.

As the cooling module 50 includes the cooling module body 51 defining the cold air producing spaces 53 and 63 in which the evaporators 54 and 64 are mounted, and cooling module covers 70 and 80 which are coupled to the cooling module body 51 to cover the cold air producing spaces 53 and 63 and on which the blower fans 72 and 82 are mounted, as described above, the evaporator 54 or 64 or the blower fan 72 or 82 may be easily accessed by decoupling the cooling module cover 70 or 80 from the cooling module body 51 when the evaporator 54 or 64 or the blower fan 72 or 82 needs to be fixed or replaced.

The cold air produced in the first cold air producing space 53 of the cooling module 50 may be supplied into the first storeroom on the upper side. Furthermore, the air that has exchanged heat in the first storeroom 21 may be collected back and circulated in the first cold air producing space 53.

For this, the cooling module 50 may include an outflow duct 55 to guide the cold air produced in the first cold air producing space 53 to the outside of the cooling module 50, and an inflow duct 56 to guide air outside the cooling module 50 into the first cold air producing space 53. Specifically, the cooling module body 51 may include the outflow duct 55 and the inflow duct 56.

In order to insulate air moving in the outflow duct 55 and the inflow duct 56, the outflow duct 55 and the inflow duct 56 may be buried in insulation 52.

The rear wall module 12 may include a supply duct 38 to supply the cold air produced in the first cold air producing space 53 into the first storeroom 21, and a collecting duct 39 to bring the air that has exchanged heat in the first storeroom 21 back into the first cold air producing space 53.

When the rear wall module 12 and the cooling module 50 are coupled to each other, the supply duct 38 of the rear wall module 12 and the outflow duct 55 of the cooling module 50 may be linked to each other, and the collecting duct 39 of the rear wall module 12 and the inflow duct 56 of the cooling module 50 may be linked to each other.

On the other hand, when the rear wall module 12 and the cooling module 50 are decoupled from each other, the supply duct 38 of the rear wall module 12 and the outflow duct 55 of the cooling module 50 may be decoupled from each other and the the collecting duct 39 of the rear wall module 12 and the inflow duct 56 of the cooling module 50 may be decoupled from each other.

As described above, the rear wall module 12 and the cooling module 50 may be interlocked and then coupled to each other through a fastening member such as screws, bolts, rivets, pins, etc. For example, the rear wall module 12 may include a convex part 12*a* protruding toward the cooling module 50, and the cooling module 50 may include a concave part 50*a* sunken to have the convex part 12*a* interlocked therein.

As described above, the rear wall module 12 may include an inner case 31 that defines the rear side of the storeroom 21, an outer case 36 coupled onto the outer surface of the inner case 31, and insulation 37 provided between the inner case 31 and the outer case 36.

The insulation 37 may include foam insulation. Specifically, the insulation may be molded by injecting a foaming liquid, in which urethane and a blowing agent are mixed up, into internal space formed by the inner case 31 and the outer case 36 and foaming the injected foaming liquid.

The supply duct 38 and the collecting duct 39 may be buried in the insulation 37 between the inner case 31 and the outer case 36. Specifically, after the supply duct 38 and the collecting duct 39 are arranged between the inner case 31 and the outer case 36 and provisionally fixed by an extra jig or adhesive, the rear wall module 12 may be built by injecting the foaming liquid between the inner case 31 and the outer case 36 and foaming the injected foaming liquid. Adhesive strength of the foaming liquid itself may allow the position of the supply duct 38 and the collecting duct 39 to be fixed.

There may be a supply hole 32 formed at the inner case 31 of the rear wall module 12 to supply the cold air flowing through the supply duct 38 into the storeroom 21. An exit of the supply duct 38 may be directly linked to the supply hole 32.

There may be a collecting hole 33 formed at the inner case 31 of the rear wall module 12 to guide the air in the storeroom 21 into the collecting duct 39. An entry of the collecting duct 39 may be directly linked to the collecting hole 33.

A supply duct link hole 34 to be linked to an entry of the supply duct 38 and a collecting duct link hole 35 to be linked to an exit of the collecting duct 39 may be formed at the inner case 31.

In this way, as the supply duct 38 is directly linked to the supply hole 32 and the collecting duct 39 is directly linked to the collecting hole 33, no extra structure may be required on the front surface of the inner case 31. This may reduce the number of overall parts, make it easy to manufacture and assemble the ducts, prevents cold air leak or occurrence of dew condensation, and improve product reliability. Furthermore, because there is no need for space for an extra duct structure, the storeroom 21 may be more spacious.

The cold air produced in the second cold air producing space 63 of the cooling module 50 may be supplied into the second and third storerooms 22 and 23 on the lower side.

The second cooling module cover 80 may include a second discharge hole 84 to supply the cold air into the second storeroom 22, and a second internal duct 83 formed within the second cooling module cover 80.

The cold air produced in the second cold air producing space 63 may be guided into the second internal duct 83. Some of the cold air guided into the second internal duct 83 from the second cold air producing space 63 may be supplied into the second storeroom 22 through the second discharge hole 84.

Some of the others of the cold air guided into the second internal duct 83 from the second cold air producing space 63 may be supplied into the second storeroom 22 through a second cold air duct (not shown) formed at the cooling module body 51 and a second cold air hole 62 formed at the cooling module body 51.

The air that has exchanged heat in the second storeroom 22 may be brought back into the second cold air producing space 63 through a second circulation hole 67 formed at the cooling module body 51 and a second circulation duct (not shown) formed at the cooling module body 51.

The cooling module body 51 may include a link duct 68 formed to link a first internal duct 73 to the second internal duct 83.

The first cooling module cover 70 may include a first discharge hole 74 to supply the cold air into the third storeroom 23, and the first internal duct 73 formed within the first cooling module cover 70.

Some of the others of the cold air guided into the second internal duct 83 from the second cold air producing space 63 may be guided into the first internal duct 73 through the link duct 68.

Some of the cold air guided into the first internal duct 73 through the link duct 68 may be supplied into the third storeroom 23 through the first discharge hole 74.

Some of the others of the cold air guided into the first internal duct 73 through the link duct 68 may be supplied into the third storeroom 23 through a first cold air duct 69 formed at the cooling module body 51 and a first cold air hole 61 formed at the cooling module body 51.

The air that has exchanged heat in the third storeroom 23 may be brought back into the second cold air producing space 63 through a first circulation hole 57 formed at the cooling module body 51 and a first circulation duct 60 formed at the cooling module body 51. The first circulation duct 60 may be formed to link the first circulation hole 57 to the second cold air producing space 63.

A damper 78 may be provided on the first cooling module cover 70 to open or close the link duct 68. When the damper 78 opens the link duct 68 the cold air is supplied into both the second storeroom 22 and the third storeroom 23, and when the damper 73 closes the link duct 68 the cold air is supplied only to the second storeroom 22.

Figure 9:
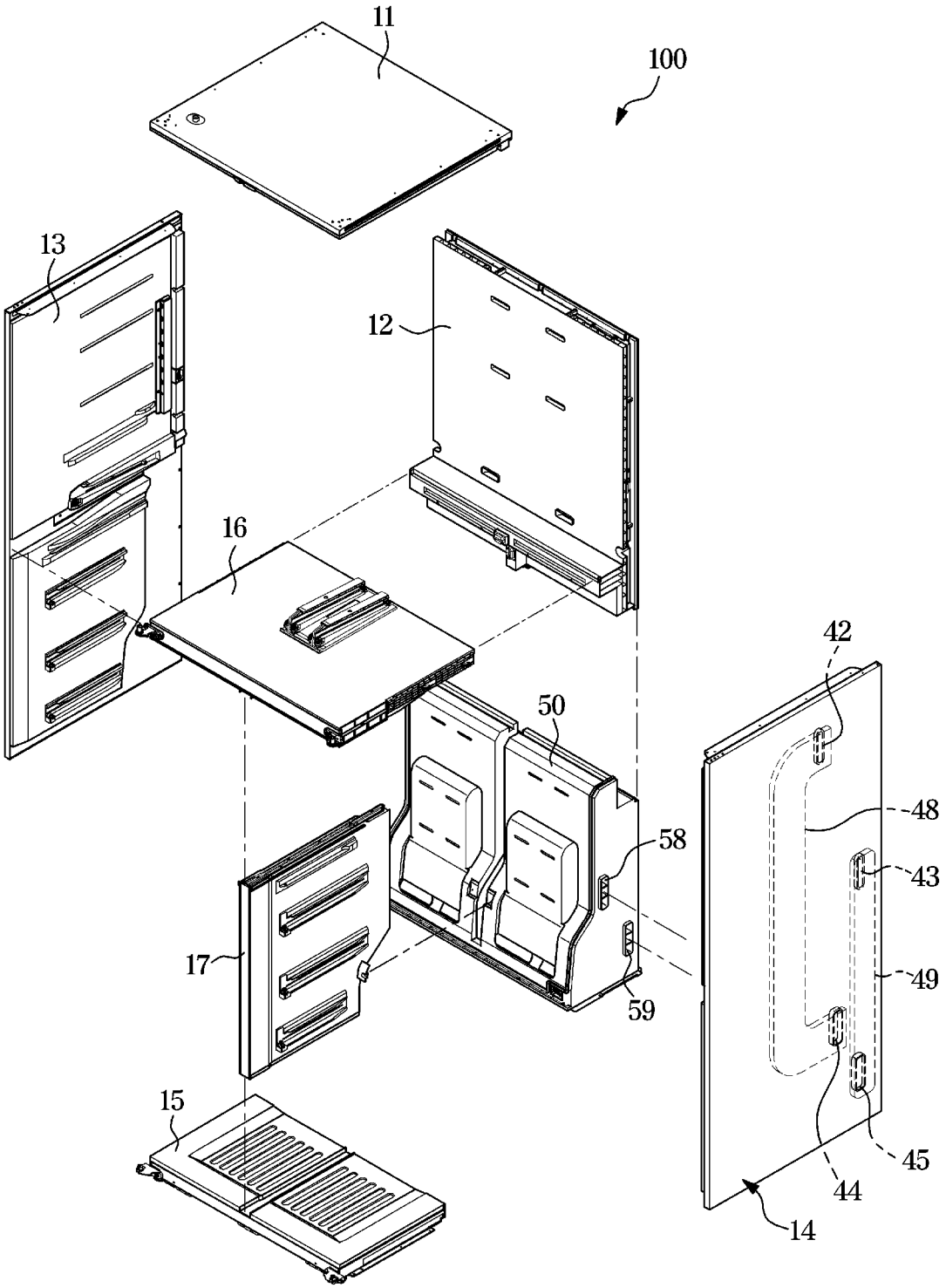
FIG. 9 shows a refrigerator broken down into a plurality of wall modules and a cooling module, according to another embodiment of the disclosure.

FIG. 9 shows a refrigerator broken down into a plurality of wall modules and a cooling module, according to another embodiment of the disclosure.

Referring to FIG. 9, a refrigerator according to another embodiment of the disclosure will be described. The same features as in the aforementioned embodiment of the disclosure are denoted by the same reference numerals, and the overlapping description will not be repeated.

In the previous embodiment, the supply duct 38 and the collecting duct 39 are formed in the rear wall module 12 to circulate the cold air produced from the cooling module 50 to the storeroom 21. Unlike this, a supply duct and a collecting duct may be formed on the side wall modules 13 and 14.

For example, a main body 100 of the refrigerator may be formed by combining the plurality of wall modules 11 to 17 and the cooling module 50, and of the plurality of wall modules 11 to 17, the right wall module 14 may include a supply duct 48 and a collecting duct 49.

The supply duct 48 may supply the cold air produced from the cooling module 50 into the first storeroom 21. The collecting duct 49 may bring the air that has exchanged heat in the first storeroom 21 back to the cooling module 50.

The right wall module 14 may include an inner case that defines the storeroom, an outer case, and insulation provided between the inner case and the outer case, and the supply duct 48 and the collecting duct 49 may be buried in the insulation.

There may be a supply hole 42 formed at the inner case of the right wall module 14 to supply the cold air flowing through the supply duct 48 into the storeroom 21. An exit of the supply duct 48 may be directly linked to the supply hole 42.

There may be a collecting hole 43 formed at the inner case of the right wall module 14 to guide the air of the storeroom 21 into the collecting duct 49. An entry of the collecting duct 49 may be directly linked to the collecting hole 43.

A supply duct link hole 44 to be linked to an entry of the supply duct 48 and a collecting duct link hole 45 to be linked to an exit of the collecting duct 49 may be formed at the inner case of the right wall module 14.

When the right wall module 14 and the cooling module 50 are coupled to each other, the supply duct 48 of the right wall module 14 and an outflow duct 58 of the cooling module 50 may be linked to each other, and the collecting duct 49 of the rear wall module 14 and an inflow duct 59 of the cooling module 50 may be linked to each other.

On the other hand, when the right wall module 14 and the cooling module 50 are decoupled from each other, the supply duct 48 of the right wall module 14 and the outflow duct 58 of the cooling module 50 may be decoupled from each other and the collecting duct 49 of the right wall module 14 and the inflow duct 59 of the cooling module 50 may be decoupled from each other.

Figure 10:
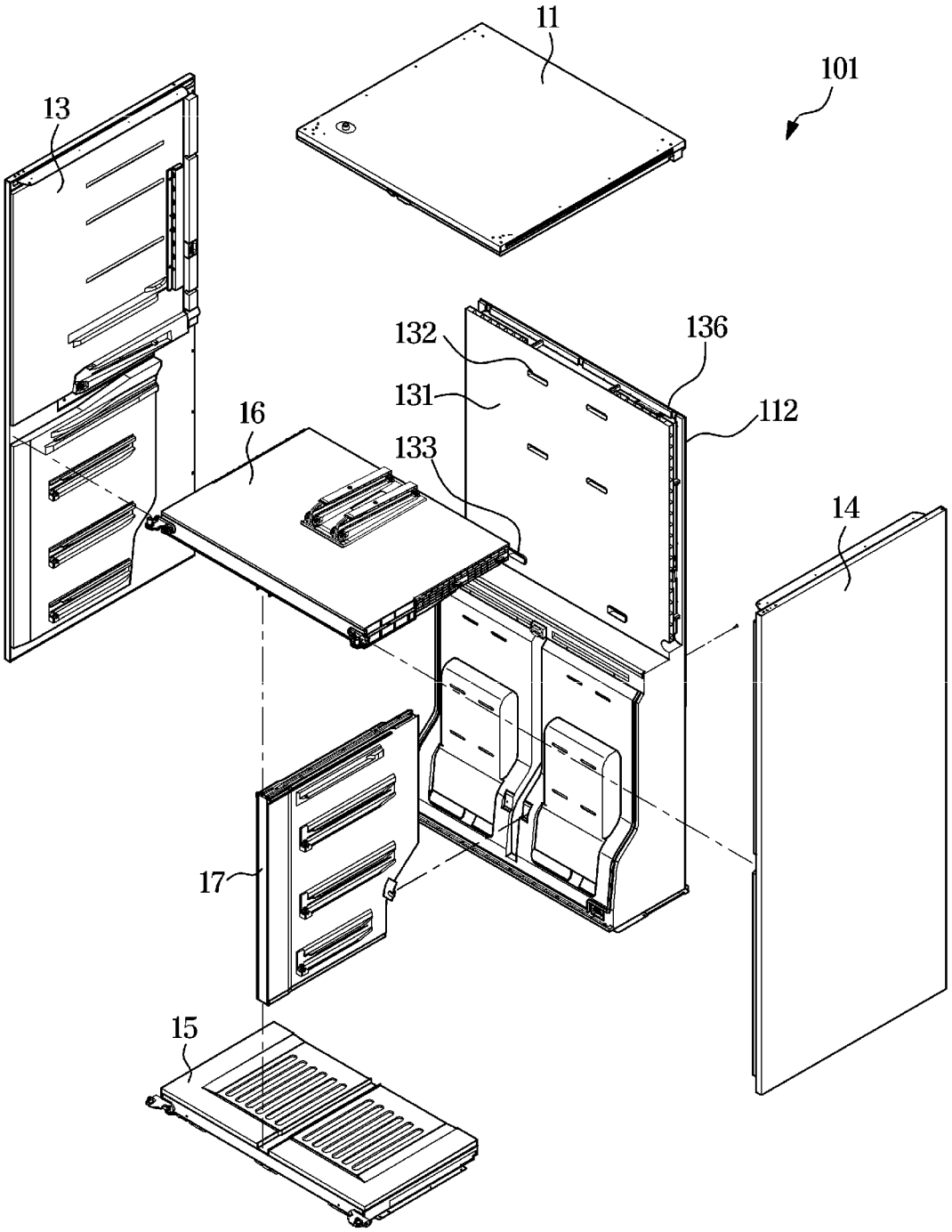
FIG. 10 shows a refrigerator broken down into a plurality of wall modules and a cooling module, according to another embodiment of the disclosure.
Figure 11:
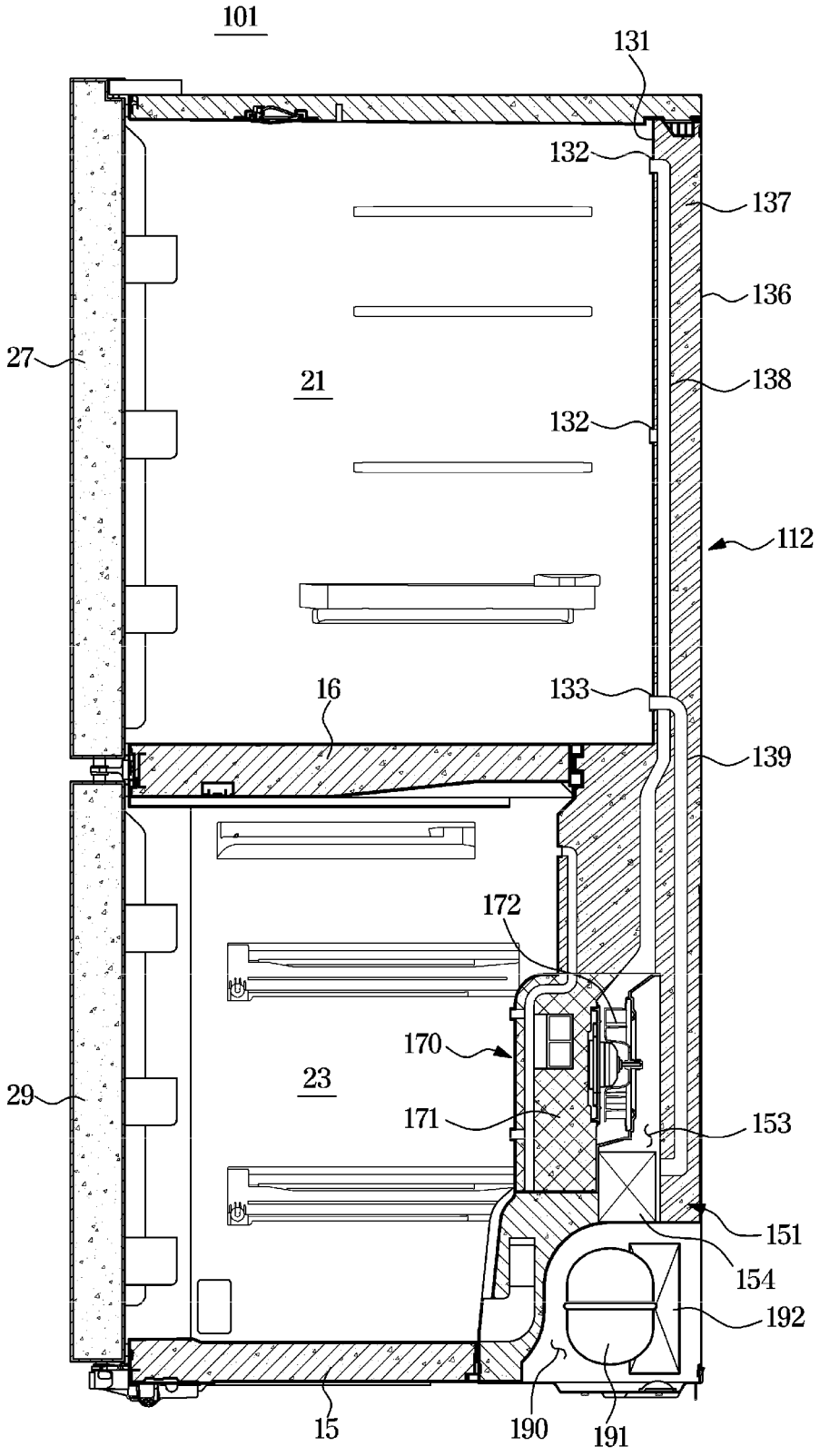
FIG. 11 is a schematic side cross-sectional view illustrating a main configuration of the refrigerator of FIG. 10.

FIG. 10 shows a refrigerator broken down into a plurality of wall modules and a cooling module, according to another embodiment of the disclosure. FIG. 11 is a schematic side cross-sectional view illustrating a main configuration of the refrigerator of FIG. 10.

Referring to FIGS. 10 to 11, a refrigerator in accordance with another embodiment of the disclosure will now be described. The same features as in the aforementioned embodiment of the disclosure are denoted by the same reference numerals, and the overlapping description will not be repeated.

Although in the previous embodiment of the disclosure the rear wall module 12 and the cooling module 50 are separately provided and assembled together, the rear wall module and the cooling module may be integrated into a unit in another embodiment.

A main body 101 of the refrigerator may be formed by assembling a plurality of wall modules 11, 13 to 17, and 112. The plurality of wall modules 11, 13 to 17, and 112 may include the top wall module 11, a rear wall module 112, the left wall module 13, the right wall module 14, the bottom wall module 15, the horizontal middle wall module 16, and the vertical middle wall module 17.

The rear wall module 112 may define the rear side of the storerooms 21, 22, and 23. The rear wall module 112 may include a compressor 191, a condenser 192, an evaporator 154, and an expansion device (not shown) for producing cold air through a refrigeration cycle. The rear wall module 112 may include a machine room 190 formed on the lower side, and the compressor 191 and the condenser 192 may be arranged in the machine room 190. The evaporator 154 may be arranged in a cold air producing space 153.

The rear wall module 112 may include a rear wall module body 151 defining the cold air producing space 153, and a module cover 170 coupled to the rear wall module body 151 to cover the cold air producing space 153. The cold air producing space 153 may be formed to have an open front, and the module cover 170 may be coupled to the rear wall module body 151 to cover the open front of the cold air producing space 153. A blower fan 172 for circulating the cold air produced in the cold air producing space 153 may be mounted on the module cover 170.

The rear wall module 112 may include a supply duct 138 to supply the cold air produced in the cold air producing space 153 into the storeroom 21, and a collecting duct 139 to bring the air that has exchanged heat in the storeroom 21 back into the cold air producing space 153.

The rear wall module body 151 may include an inner case 131 that defines the rear side of the storeroom 21, an outer case 136 coupled onto the rear surface of the inner case 131, and insulation 137 provided between the inner case 131 and the outer case 136.

The supply duct 138 and the collecting duct 139 may be buried in the insulation 137.

There may be a supply hole 132 formed at the inner case 131 to supply the cold air flowing through the supply duct 138 into the storeroom 21. An exit of the supply duct 138 may be directly linked to the supply hole 132.

There may be a collecting hole 133 formed at the inner case 131 to guide the air in the storeroom 21 into the collecting duct 139. An entry of the collecting duct 139 may be directly linked to the collecting hole 133.

According to the disclosure, the main body of a refrigerator may be easily manufactured by assembling a plurality of wall modules and a cooling module, and the plurality of wall modules and the cooling module may be standardized for common use in various models.

According to the disclosure, when a local part of the main body of the refrigerator needs to be fixed or replaced, the corresponding module may be separated for the repairs or replacement.

According to the disclosure, as a duct for transfer of cold air is included inside the wall module, no extra duct structure is required for transfer of cold air, thereby having a more spacious storeroom.

According to the disclosure, when the plurality of wall modules and the cooling module are coupled to each other, the duct included in the wall module and a duct equipped in the cooling module are linked, thereby simplifying the assembling process and improving productivity.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. A refrigerator comprising:

a plurality of wall modules including a top wall module, a bottom wall module, a rear wall module, a left wall module, and a right wall module coupled together to define a storeroom; and a cooling module detachably coupleable to a duct wall module which is one of the rear wall module, the left wall module, or the right wall module; and wherein the cooling module includes a cooling module body forming a cold air producing space and a machine room, a compressor and a condenser arranged in the machine room, and an evaporator arranged in the cold air producing space to produce cold air, and wherein the duct wall module includes:

a supply duct configured to supply the cold air produced from the cooling module to the storeroom when the cooling module is coupled to the duct wall module; and a collecting duct configured to bring air having exchanged heat in the storeroom back to the cooling module when the cooling module is coupled to the duct wall module.

2. The refrigerator of claim 1, wherein the duct wall module comprises an inner case defining an inner wall of the storeroom, an outer case coupled to an outer surface of the inner case, and insulation between the inner case and the outer case, and wherein the supply duct and the collecting duct are positioned in the insulation.

3. The refrigerator of claim 2, wherein the inner case of the duct wall module comprises a supply hole configured to supply cold air supplied through the supply duct to the storeroom.

4. The refrigerator of claim 3, wherein the supply duct is coupled to the supply hole.

5. The refrigerator of claim 2, wherein the inner case of the duct wall module comprises a collecting hole formed to guide air from the storeroom to the collecting duct.

6. The refrigerator of claim 5, wherein the collecting duct is coupled to the collecting hole.

7. The refrigerator of claim 1, wherein the cooling module is coupled to a lower portion of the rear wall module, and the cooling module defines at least a portion of the rear surface of the storeroom.

8. The refrigerator of claim 1, wherein the cooling module comprises insulation configured to insulate the cold air producing space.

9. The refrigerator of claim 8, wherein the cooling module further comprises an outflow duct to guide the cold air produced in the cold air producing space from the cooling module; and an inflow duct to guide the air having the exchanged heat to the cold air producing space.

10. The refrigerator of claim 9, wherein the outflow duct and the inflow duct are positioned in the insulation of the cooling module.

11. The refrigerator of claim 9, wherein the duct wall module is configured to be coupled to the cooling module such that when the duct wall module and the cooling module are coupled to each other, the outflow duct of the cooling module and the supply duct of the duct wall module are linked to each other and the inflow duct of the cooling module and the collecting duct of the duct wall module are linked to each other, and wherein when the duct wall module and the cooling module are decoupled from each other, the outflow duct and the supply duct are decoupled from each other and the inflow duct and the collecting duct are decoupled from each other.

12. The refrigerator of claim 11, further comprising a blower fan mounted on the cooling module cover to circulate air between the storeroom and the cold air producing space.

13. The refrigerator of claim 8, wherein the cooling module comprises a cooling module cover coupled to the cold air module body to cover the cold air producing space.

* * * * *